US006154973A

United States Patent [19]

Theurer et al.

[11] Patent Number: 6,154,973

[45] Date of Patent: Dec. 5, 2000

[54] METHOD FOR CORRECTING THE TRACK GEOMETRY OF A TRACK

[75] Inventors: Josef Theurer, Vienna; Bernhard Lichtberger, Leonding, both of Austria

[73] Assignee: Franz Plasser Bahnbaumaschinen-Industriegesellschaft m.b.H., Vienna, Austria

[21] Appl. No.: 09/251,368

[22] Filed: Feb. 17, 1999

[30] Foreign Application Priority Data

Mar. 27, 1998 [AT] Austria ..... 548/98

[51] Int. Cl.[7] ..... E01B 29/04

[52] U.S. Cl. ..... 33/651; 33/338; 33/1 Q; 104/7.1; 104/12

[58] Field of Search ..... 33/651, 1 Q, 287, 33/338; 104/2, 7.1, 8, 10, 12

[56] References Cited

U.S. PATENT DOCUMENTS

| | | | |
|---|---|---|---|
| 3,041,982 | 7/1962 | Plasser et al. | 33/287 |
| 4,497,255 | 2/1985 | Theurer | 33/1 Q |
| 4,655,142 | 4/1987 | Theurer | 33/338 |
| 5,007,349 | 4/1991 | Theurer | 104/12 |
| 5,301,548 | 4/1994 | Theurer | 33/287 |
| 5,481,982 | 1/1996 | Theurer et al. | 33/287 |
| 5,605,099 | 2/1997 | Sroka et al. | 104/2 |

FOREIGN PATENT DOCUMENTS 0 666 371 A1 8/1995 European Pat. Off. .

OTHER PUBLICATIONS

"Railway Track & Structures" by William C. Vantuono, Mar. 1996: Speed needs: Integrated high–speed m/w equipment.

*Primary Examiner*—Christopher W. Fulton
*Attorney, Agent, or Firm*—Henry M. Feiereisen

[57] ABSTRACT

A method for correcting the track geometry of a track, includes measuring an initial track position of the track following lifting of the track and tamping under the track, and so computing a final desired track position as to eliminate long-wave alignment errors of the track geometry. Subsequently, corrective values are determined commensurate with a difference between the final desired track position and the initial track position, and the track is stabilized by lowering the track in a controlled manner into the final desired position and controlling in response to the corrective values the static load and/or transverse vibration acting on the track, thereby eliminating during track stabilization in particular long-wave geometrical track errors.

1 Claim, 3 Drawing Sheets

METHOD FOR CORRECTING THE TRACK GEOMETRY OF A TRACK

CROSS-REFERENCES TO RELATED APPLICATIONS

This application claims the priority of Austrian Patent Application, Serial No. A 548/98, filed Mar. 27, 1998, the subject matter of which is incorporated herein by reference.

BACKGROUND OF THE INVENTION

The present invention relates, in general, to geometric problems of tracks, and in particular to a method for correcting the track geometry of a track, in which the track is elevated into an initial track position and tamped, and subsequently, the track is stabilized involving a lowering in a controlled manner of the track into a final desired track position while simultaneously applying a vertical static load in conjunction with transverse vibrations.

In an article by William C. Vantuono, published in magazine "Railway Track & Structures, March 1996, pages 29–33, a method for correcting the track geometry is disclosed, using a so-called "mechanical continuous-action train" or MDZ which includes a high-performance tamping machine, a ballast plow and a track stabilizer traveling in an operating direction. This work unit of three cars continuously travels at operation, with the tamping machine positioning the track in a correct, initial track position and subsequently ballasting the track in conformity to regulations. Finally, the track is lowered by the track stabilizer in a controlled manner into a final desired track position while applying a static vertical load in combination with horizontal transverse vibrations.

SUMMARY OF THE INVENTION

It is an object of the present invention to provide an improved method for realizing a correct track geometry of a track.

This object, and others which will become apparent hereinafter, are attained in accordance with the present invention by measuring the initial track position following lifting and tamping of the track, so computing a desired final track position as to eliminate long-wave alignment errors of the track geometry, determining corrective values commensurate with a difference between the final desired track position and initial track geometry, and stabilizing the track by lowering the track in a controlled manner into the final desired track position and controlling the static load and/or transverse vibrations acting on the track in response to the corrective values.

The method according to the present invention is based on the recognition to exploit track stabilization, which follows track tamping, not only for artificially countering an initial settling but also for a final correction of possibly encountered, in particular long-wave, geometric errors of the track. Thus, in accordance with the present invention, the initial track geometry immediately after tamping is measured and recorded by a built-in reference system of the tamping machine for computing the long-wave corrective values for cross level and lateral track position of the track by means of an electronic compensation process for revising the track ordinates with respect to a series of chords ("string-lining procedure"). The throw of the curve either in or out in order to correct the cross level and lateral track position in response to the computed corrective values can be carried out in the most economical manner parallel to the track stabilization by controlling accordingly force components applied for track stabilization, such as static vertical load and/or transverse forces. Thus, the track stabilization is advantageously exploited to conclude a correction of the track geometry and in addition to eliminate long-wave geometrical track errors, without the need for additional means.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
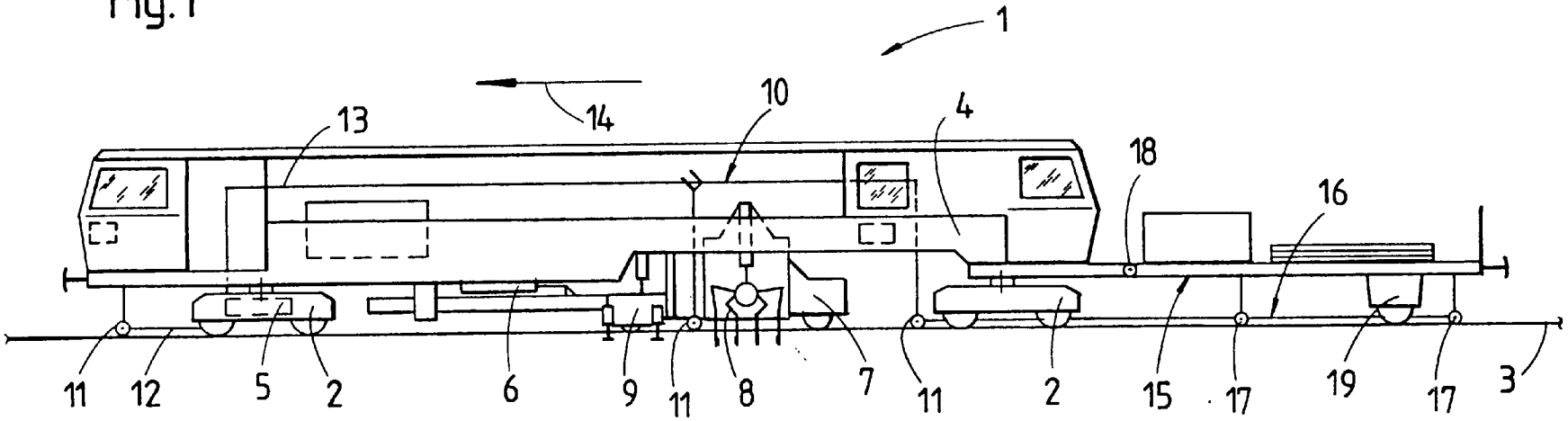
FIG. 1 is a side elevational view of a tamping machine for tamping ballast under a track, having incorporated therein part of a correction system for track geometry in accordance with the present invention.

Throughout all the Figures, same or corresponding elements are generally indicated by same reference numerals.

Turning now to the drawing, and in particular to FIG. 1, there is shown a side elevational view of a tamping machine, generally designated by reference numeral 1, for tamping ballast under a track 3. The tamping machine 1 has a machine frame 4 which is supported by undercarriages 2 for mobility along the track 3 in operating direction indicated by arrow 14. Positioned between the undercarriages 2 is a subframe 7 which is movable by a drive 6 relative to the machine frame 4 in a longitudinal direction. The subframe 7 is connected to a vertically adjustable tamping unit 8 and to a track lifting unit 9. Associated to the machine frame 4 is a machine-own reference system, generally designated by reference numeral 10 for determining track ordinates and thereby errors of the cross level and lateral track position of the track 3. The reference system 10 includes feeler rods 11 which are spaced from one another longitudinally in direction of the machine frame 4 and running on the track 3 for sensing the track, and a lining and leveling chord 12, 13 in the form of e.g. tensioned reference wires.

Trailing the tamping machine 1 in operating direction 14 is a measuring car, generally designated by reference numeral 15 which has its own reference system, generally designated by reference numeral 16 and includes feeler rods 17. The leading end of the car 15 is linked via a hinge 18 to the machine frame 4 while its trailing end is supported by an undercarriage 19 for mobility along the track 3.

Figure 2:
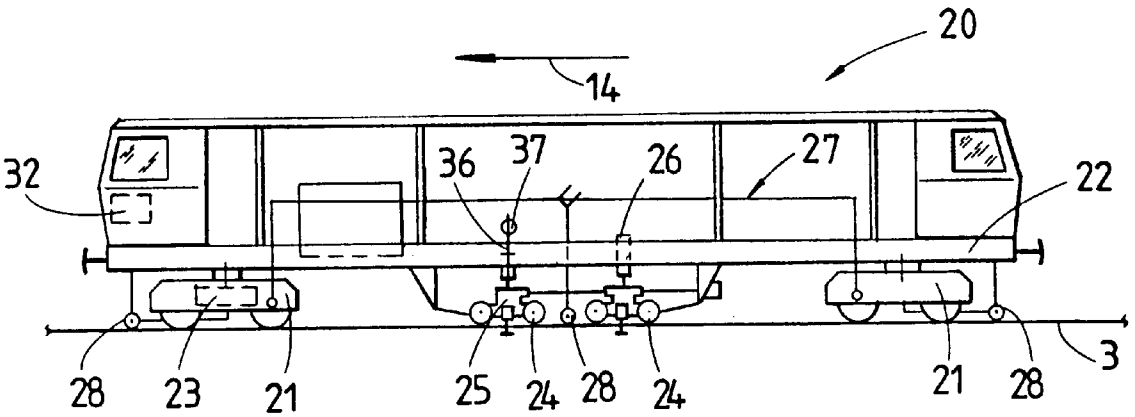
FIG. 2 is a side elevational view of a track stabilizer for stabilizing tamped ballast underneath the track, having incorporated therein another part of the correction system for track geometry in accordance with the present invention.

FIG. 2 shows a side elevational view of a track stabilizer, generally designated by reference numeral 20, for stabilizing compacted ballast under the track 3. The track stabilizer 20 includes a machine frame 22 which is supported by undercarriages 21 and propelled by a drive 23 for mobility along the track 3. Positioned between both undercarriages 21 are two track stabilization assemblies 24 which have an eccentric drive 25 for applying onto the track 3 horizontal vibrations transversely to the longitudinal direction of the track 3. In addition, the track stabilization assemblies 24 have drives 26 for applying a vertical static load onto the track 3, and are provided with a reference system, generally designated by reference numeral 27 and including feeler rods 28, for measuring and recording the track geometry. Suitably, the track stabilizer 20 follows immediately the tamping machine 1 in the operating direction 14. Optionally the transverse vibration may be complemented by transverse forces which are applied onto the track 3 by a lever system 36 with a drive 37 for correcting the lateral track position of the track 3. A specific construction and manner in which such a lever system 36 operates is fully described in European Patent Application 0 666 371, published Aug. 9, 1995, the entire specification and drawings of which are expressly incorporated herein by reference.

Figure 3:
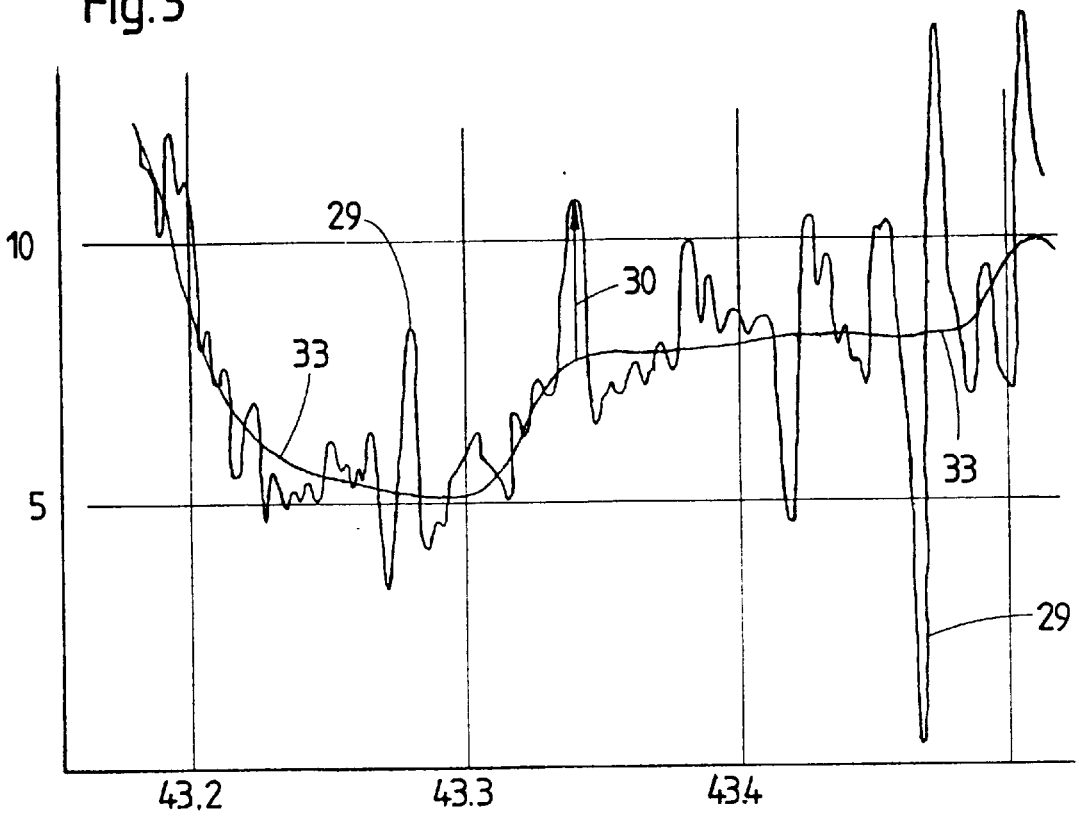
FIG. 3 is a graphical illustration of actual track ordinates plotted over a track section.

Turning now to FIG. 3, there is shown a graphical illustration of track or midordinates 30 in millimeters on the Y-axis as a function of the track path in kilometers plotted on the X-axis. In the following description the term "track ordinate" or "midordinate" of a curve denotes a distance of a normal between a chord of an arcuate track curve and a point on the curve, with the magnitude of the distance depending, for example, on the curvature of the track curve, length of chord etc. The profile can thus be used as measurement for the curvature of the curved track. When the curved track is out of line, the midordinates 30 will not be equal. This situation is shown in FIG. 3 by graph 29 which is composed of a plurality of midordinates 30. Thus, graph 29 illustrates the actual errors of the lateral track position of the track 3 and thus, the curve track must be moved either in or out to conform to the compensation graph 33. The graph 29 is determined by the reference system 10 of the tamping machine 1 immediately before track tamping. The measured midordinates 30 are electronically compensated by conventional computer programs whereby maximum admissible adjustment values should be taken into account. In order to correct the alignment of the curved track and to smooth the curve, required adjustments of the track 3 either in or out are computed by conventional factorizing processes.

Figure 4:
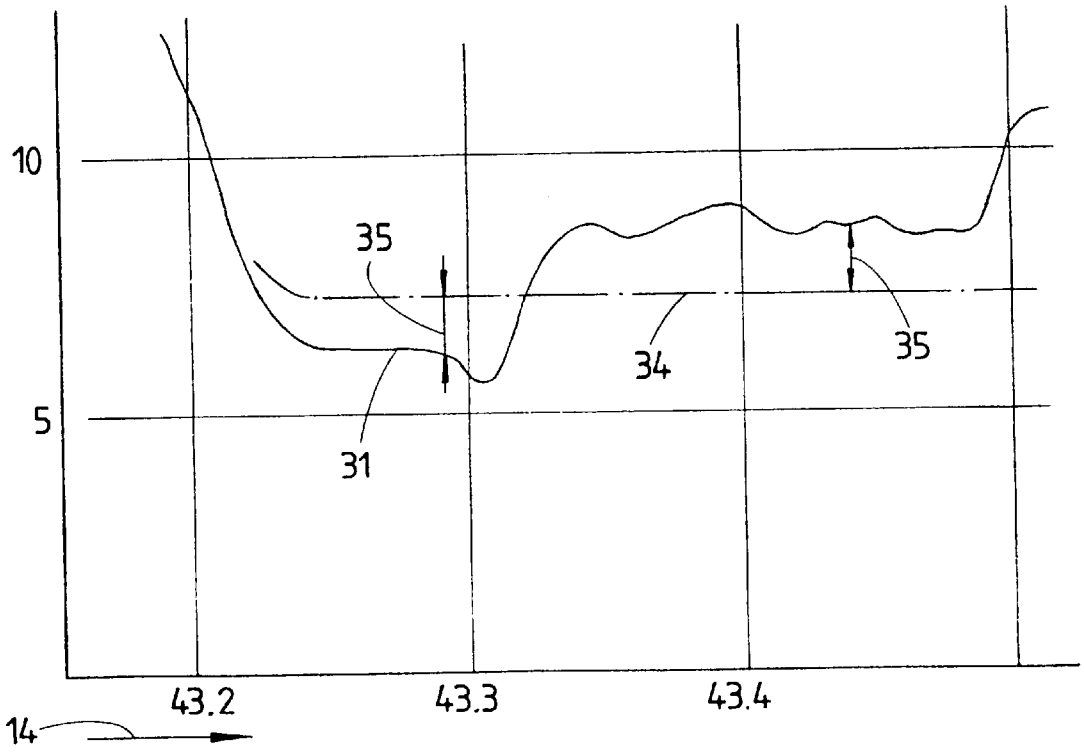
FIG. 4 is a graphical illustration of actual and desired graphs relating to the lateral track position of the track.

FIG. 4 shows in continuous line a graph which represents the track position actually realized immediately after tamping operation and designated here as desired initial track position 31 of the track 3. This initial track position 31 is measured by the measuring car 14 immediately after tamping and clearly shows long-wave geometrical track errors. Persons skilled in the art will understand that the measurement by the car 15 may also be carried out by a separate track measuring car. Data determined by the car 15 may be suitably transmitted, for example wireless, to the immediately trailing track stabilizer 20, or the data may be transmitted by diskette or modem. The transmitted data are inputted into a computer 32 located on the track stabilizer 20. Subsequently, a conventional electronic compensation and factorizing process computes from the determined track ordinates 30 long-wave corrective values 35 for correction of the cross level and lateral track position of the track 3. The determined corrective values 35 enable the track stabilizer 20 to precisely carry out the subsequent track stabilization by scanning the track on three points and alignment of the track in response to the predetermined corrective values and desired track ordinates, i.e. the track stabilizer 20 is able to carry out simultaneously with lowering of the track for countering the initial settling of the ballast bed, a final correction of the track geometry. The alignment of the track 3 in response to the corrective values 35 relating to the desired lateral track position can be realized by respectively controlling the lining forces applied by the track stabilization assemblies 24 in the form of vibrations in a horizontal plane transversely to the track and/or through respective activation of the drives 37 to operate the level system 36. The alignment of the track 3 in response to the corrective values 35 relating to the cross level of the track can be realized by controlling the vertical static load applied by the drives 26, whereby it should be taken into consideration that cross level correction can be effected only though lowering of the track 3.

FIG. 4 shows a graphical illustration for correcting the lateral track position, with graph 31 showing the desired initial track position 31. Illustrated by dashdot line is a graph 34 which represents the desired final track position which is computed after carrying out the electronic track ordinate compensation process and factorization process on the basis of the initial desired track position 31 after track tamping. The corrective values 35 are generated through determination of the deviations between the initial track position 31 and the final desired track position 34. When the track stabilizer 20 travels in the operating direction 14, the correct alignment of the track between kilometer marking 43.22 and kilometer marking 43.32 is realized by increasing the lining forces in transverse direction to the left in response to the determined corrective values 35 to move the track 3 into the determined final desired track position 34. Subsequently, the transverse lining forces are increased to the right for correcting the lateral track position.

Figure 5:
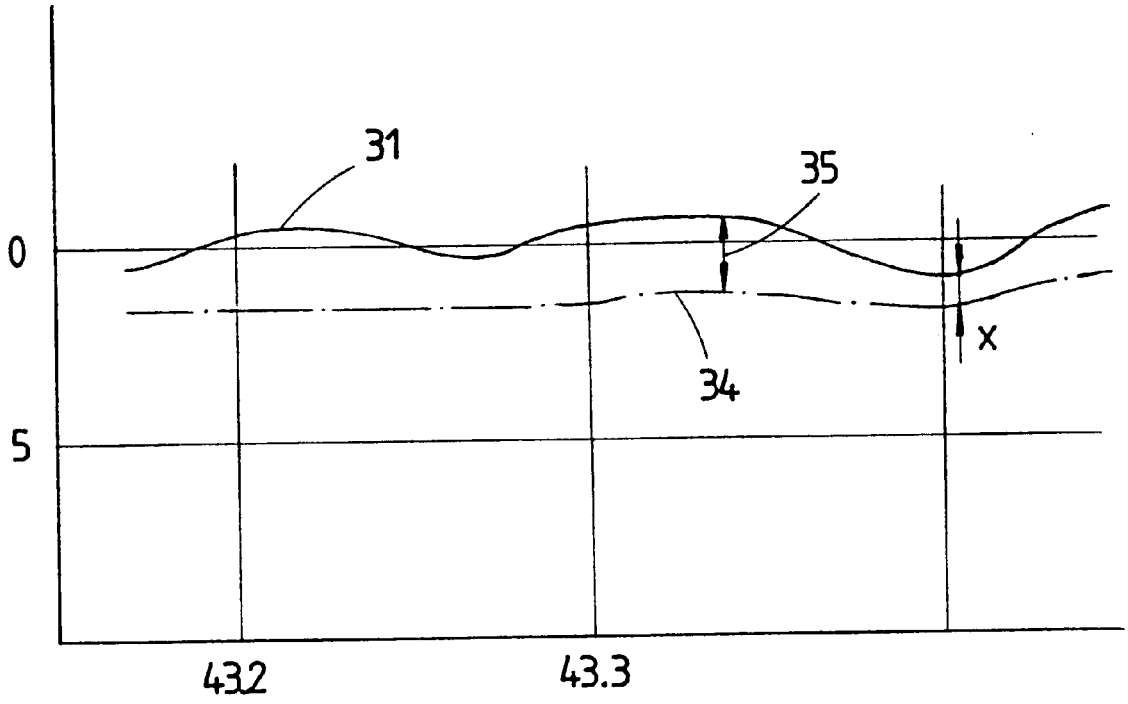
FIG. 5 is a graphical illustration of actual and desired graphs relating to the cross level of the track.

FIG. 5 shows a graphical illustration for correcting the cross level of the track 3, i.e. vertical relation between the top of the rails of the track. Reference numeral 31 again indicates the initial desired track position while reference numeral 34 indicates the final desired track position 34 by way of dashdot line. Upon computation of the final desired track position 34, it should be noted that in all track sections, the track should be lowered by at least a minimum, designated by reference character x. An increase of the static load in the area of particular cross level positions of the initial desired track position 31 enables a complete elimination or at least flattening of long-wave cross level errors in order to finally lower the track 3 into the desired final position 34.

While the invention has been illustrated and described as embodied in a method for correcting the track geometry of a track, it is not intended to be limited to the details shown since various modifications and structural changes may be made without departing in any way from the spirit of the present invention.

What is claimed is:

1. A method for correcting the track geometry of a track, comprising the steps of:

measuring an initial track position of the track following lifting of the track and tamping under the track;

so computing a final desired track position as to eliminate long-wave alignment errors of the track geometry;

determining corrective values commensurate with a difference between the final desired track position and the initial track position; and stabilizing the track by lowering the track in a controlled manner into the final desired position and controlling at least one lining force selected from the group consisting of static load and transverse vibrations acting on the track, in response to the corrective values.

* * * * *